US007479006B2

(12) United States Patent
Newsom

(10) Patent No.: US 7,479,006 B2
(45) Date of Patent: Jan. 20, 2009

(54) APPARATUS AND METHODS FOR OPERATING A COOKING APPLIANCE

(75) Inventor: Paul E. Newsom, Louisville, KY (US)

(73) Assignee: General Electric Company, Schenectady, NY (US)

( * ) Notice: Subject to any disclaimer, the term of this patent is extended or adjusted under 35 U.S.C. 154(b) by 47 days.

(21) Appl. No.: 11/497,781

(22) Filed: Aug. 2, 2006

(65) Prior Publication Data

US 2008/0096147 A1 Apr. 24, 2008

(51) Int. Cl.
*F23N 1/02* (2006.01)

(52) U.S. Cl. ..... 431/12; 126/42; 126/39 N

(58) Field of Classification Search ..... 126/42, 126/39 N, 39 G, 39 R; 431/153, 12; 137/78.4, 137/384.2, 384.4, 384.6, 384.8
See application file for complete search history.

(56) References Cited

U.S. PATENT DOCUMENTS 4,779,839 A * 10/1988 Sears ..... 251/68
5,241,463 A * 8/1993 Lee ..... 700/90
5,244,379 A * 9/1993 Stirling et al. ..... 431/6
5,313,975 A * 5/1994 Nimberger ..... 137/14
5,400,766 A * 3/1995 Dillon ..... 126/42
5,649,818 A * 7/1997 Day ..... 431/6
5,655,900 A * 8/1997 Cacciatore ..... 431/70
5,662,465 A 9/1997 Kano
5,694,916 A * 12/1997 Gambill et al. ..... 126/42
5,722,448 A * 3/1998 Dourado ..... 137/78.4
5,875,773 A * 3/1999 Jansen ..... 126/42
5,954,045 A * 9/1999 Bhanot ..... 126/52
6,000,390 A * 12/1999 Evers et al. ..... 126/42
6,041,768 A * 3/2000 Giammona et al. ..... 126/39 J
6,126,435 A 10/2000 Fredin-Garcia et al.
6,843,243 B2 * 1/2005 Steurer ..... 126/42
7,045,748 B2 * 5/2006 Blackson et al. ..... 219/446.1
2004/0069293 A1 * 4/2004 Steurer ..... 126/39 R
2005/0077366 A1 4/2005 Berns et al.
2005/0229918 A1 * 10/2005 Shim ..... 126/39 BA
2006/0016445 A1 * 1/2006 Cadima et al. ..... 126/39 BA

* cited by examiner

*Primary Examiner*—Alfred Basichas
(74) *Attorney, Agent, or Firm*—George L. Rideout, Esq.; Armstrong Teasdale LLP

(57) ABSTRACT

A gas supply system for a cooking appliance includes a burner valve operatively coupled to each surface burner, and a lockout valve configured to control gas flow to a manifold. The burner valve is movable between an open position and a closed position to control gas flow from the manifold to the surface burner. The lockout valve is movable between a closed position restricting gas flow to the manifold and an open position allowing gas flow. The system includes at least one switch positioned with respect to the burner valve. The switch is configured to detect a position of the burner valve. A controller is operatively coupled to the lockout valve and the switch. The controller activates the lockout valve to move between the closed position and the open position based on a signal received from the switch indicating that the burner valve is in the closed position.

20 Claims, 7 Drawing Sheets

APPARATUS AND METHODS FOR OPERATING A COOKING APPLIANCE

BACKGROUND OF THE INVENTION

This invention relates generally to gas cooking appliances and, more particularly, to methods and apparatus for controlling gas supply in a cooking appliance.

Gas-fired stoves, ovens, and ranges typically include one or more gas heating elements, such as surface burner elements, coupled to a main gas line for providing fuel to the heating elements. In a domestic range, a gas line is connected to a distribution manifold within the appliance to direct gas to a plurality of surface burner elements on a cooktop or to cooking elements within an oven cavity. Operation of the surface burner elements and/or cooking elements is typically accomplished with control knobs mounted on either a front or back wall of the appliance. When a control knob is actuated, fuel is supplied to an associated heating element and an ignition module creates a spark to ignite the gas and produce a flame.

Potentially undesirable conditions may result if a control knob is unknowingly or unwittingly turned to light the corresponding burner or, alternatively, to allow gas to flow through the burner without igniting. To address these concerns, some conventional gas cooking appliances include a lockout valve to prevent gas flow to the burners when actuated (sometimes referred to as a lockout condition), and thus the appliance can be rendered inoperable as desired. However, at least some known cooking appliances operate the lockout valve without regard to the status of the burner control knobs. As such, gas that has not been lit may be unintentionally introduced into the room when the lockout valve is de-actuated without regard to whether one or more burner control knobs are actuated.

BRIEF DESCRIPTION OF THE INVENTION

In one aspect, a gas supply system for a cooking appliance is provided. The cooking appliance includes at least one gas surface burner element in selective flow communication with a manifold. The manifold is in flow communication with a gas supply line. The gas supply system includes a surface burner element control valve operatively coupled to each surface burner element. The surface burner element control valve is movable between an open position and a closed position to control gas flow from the manifold to the surface burner element. A lockout valve is operatively coupled to the manifold along the gas supply line and configured to control gas flow to the manifold. The lockout valve is movable between a closed position restricting gas flow to the manifold and an open position allowing gas flow to the manifold. The gas supply system includes at least one switch positioned with respect to the surface burner element control valve. The at least one switch is configured to detect a position of the surface burner element control valve. A controller is operatively coupled to the lockout valve and the switch. The controller is configured to activate the lockout valve to move between the closed position and the open position based on a signal received from the at least one switch indicating that the surface burner element control valve is in the closed position.

In another aspect, a cooking appliance is provided. The cooking appliance includes a manifold in flow communication with a gas supply line. At least one gas surface burner element is in selective flow communication with the manifold. A surface burner element control valve is coupled to the corresponding surface burner element. The surface burner element control valve is configured to control gas flow from the manifold to the corresponding surface burner element. The cooking appliance also includes a lockout valve coupled in flow communication with the manifold. The lockout valve is movable between a closed position restricting gas flow to the manifold and an open position allowing gas flow to the manifold. A controller is operatively coupled to the lockout valve. The controller is configured to activate the lockout valve to move from the open position to the closed position based on an operational status of each surface burner element control valve.

In another aspect, a method for controlling a gas supply for a cooking appliance is provided. The method includes providing a manifold in flow communication with a gas supply line. At least one gas surface burner element is coupled in selective flow communication with the manifold. A surface burner element control valve is coupled to a corresponding surface burner element. The surface burner element control valve is configured to control gas flow from the manifold to the surface burner element. The method also includes coupling a lockout valve in flow communication with the manifold. The lockout valve is movable between a closed position restricting gas flow to the manifold and an open position allowing gas flow to the manifold. A controller is operatively coupled to the lockout valve. The controller is configured to activate the lockout valve to move from the open position to the closed position based on an operational status of each surface burner element control valve.

DETAILED DESCRIPTION OF THE INVENTION

Figure 1:
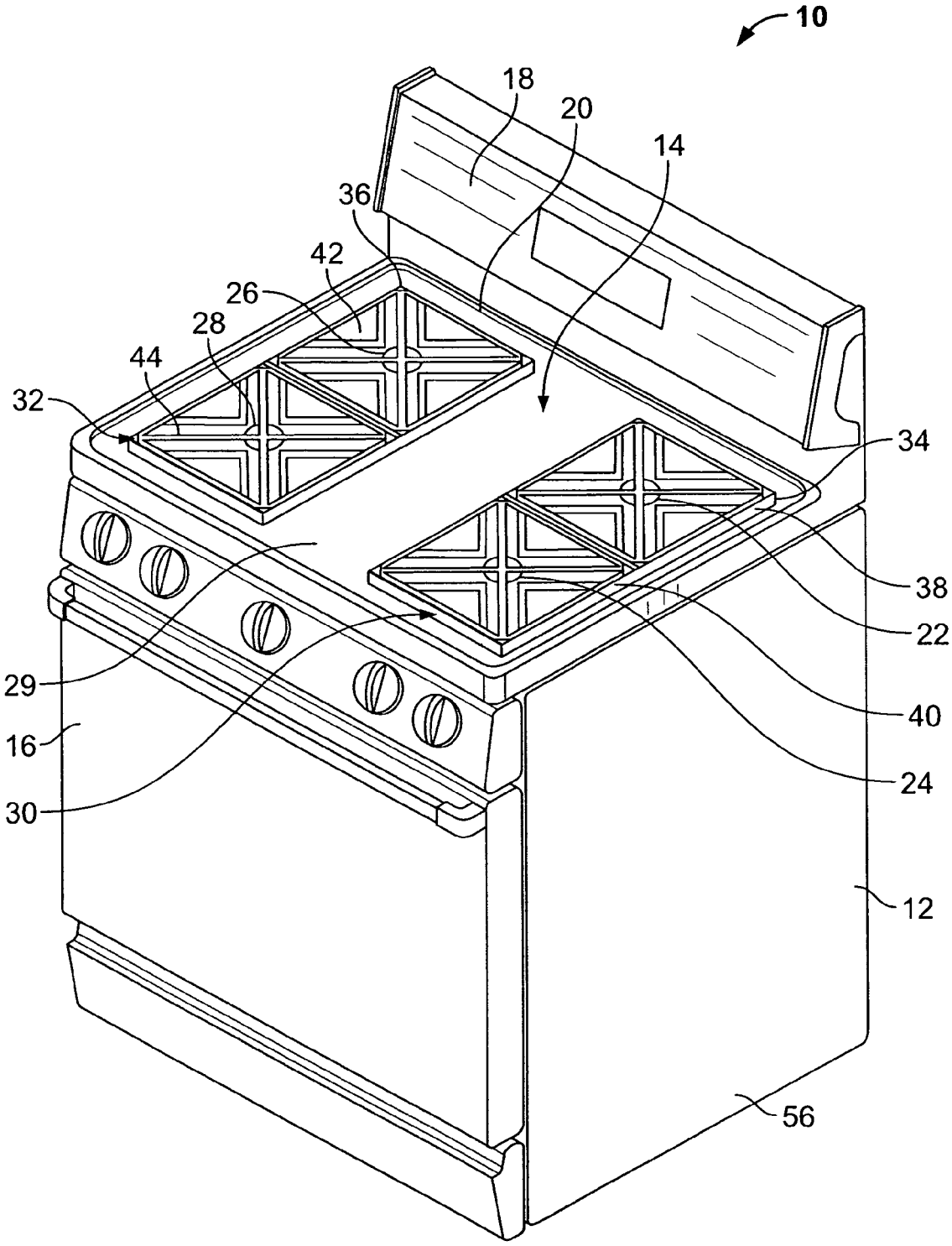
FIG. 1 is a perspective view of an exemplary free standing gas range.

FIG. 1 is a perspective view of a gas cooking appliance in the form of a free standing gas range 10 including an outer body or cabinet 12 that includes a generally rectangular cooktop 14. An oven, not shown, is positioned below cooktop 14 and has a front-opening access door 16. A range backsplash 18 extends upward from a rear portion 20 of cooktop 14 and contains various control selectors (not shown) for selecting operative features of heating elements for cooktop 14 and/or the oven. It is contemplated that the present invention is applicable, not only to cooktops which form the upper portion of a range, such as range 10, but to other forms of cooktops as well, such as, but not limited to, free standing cooktops that are mounted to kitchen counters. Therefore, gas range 10 is provided by way of illustration rather than limitation, and accordingly there is no intention to limit application of the present invention to any particular appliance or cooktop, such as range 10 or cooktop 14. In addition, it is contemplated that the present invention is applicable to duel fuel cooking appliances, e.g., a gas cooktop with an electric oven.

Cooktop 14 includes four gas fueled surface burners 22, 24, 26, 28, which are positioned in spaced apart pairs 22, 24 and 26, 28 positioned adjacent each side of cooktop 14. In one embodiment, each pair of burners 22, 24 and 26, 28 is surrounded by a recessed area (not shown in FIG. 1) respectively, of cooktop 14. The recessed areas are positioned below an upper surface 29 of cooktop 14 and serve to catch any spills on cooktop 14. Each burner 22, 24, 26, 28 extends upwardly through an opening in cooktop 14, and a grate assembly 30, 32 is positioned over each respective pair of burners, 22, 24 and 26, 28. Each grate assembly 30, 32 includes a respective frame 34, 36, and separate supporting grates 38, 40, 42, 44 are positioned above the cooktop recessed areas and overlie respective burners 22, 24, 26, 28.

Figure 2:
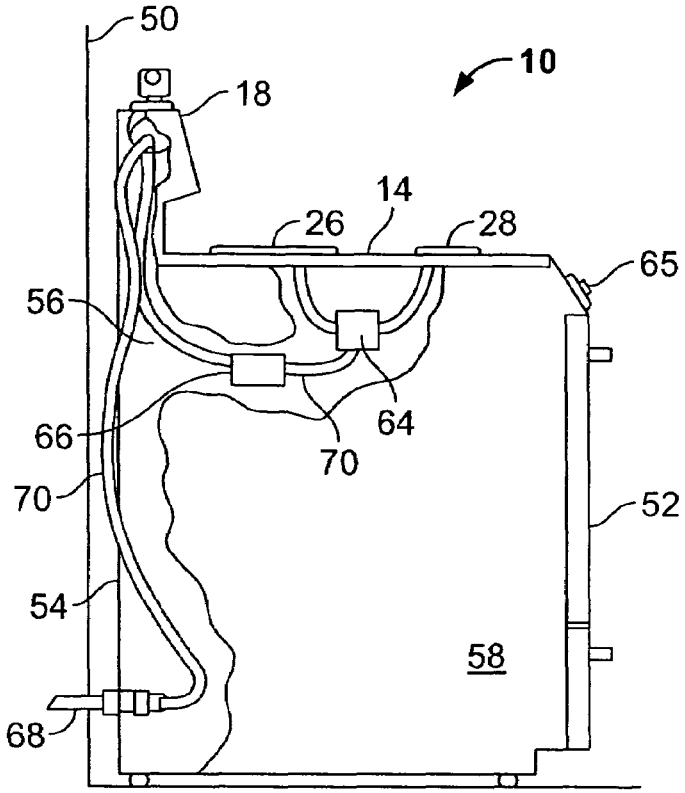
FIG. 2 is a side elevational view of the gas range shown in FIG. 1 with a section of the cabinet removed.

FIG. 2 illustrates range 10 mounted adjacent a kitchen wall 50. Range 10 includes a front panel 52, a rear wall 54, laterally spaced side walls 56 (shown in FIG. 1) and 58, and backsplash 18. Gas burners 22, 24, 26, and 28 of cooktop 14 are in selectively flow communication with a gas line manifold 64. A plurality of burner control knobs 65 are mounted on front panel 52 of range 10 in front of cooktop 14. A gas appliance connector hose or gas supply line 70 is connected between a main supply line 68 and gas line manifold 64, and a gas lockout valve assembly 66 is connected to or in line with gas line manifold 64 along gas supply line 70. In one embodiment, gas assembly 66 regulates gas flow between main gas supply line 68 and gas manifold 64. While lockout valve assembly 66 is illustrated coupled to gas supply line 70 between backsplash 18 and manifold 64, it is contemplated that gas lockout assembly 66 may be located elsewhere in appliance 10, such as at a location at or near the main gas line connection to appliance 10.

Figure 3:
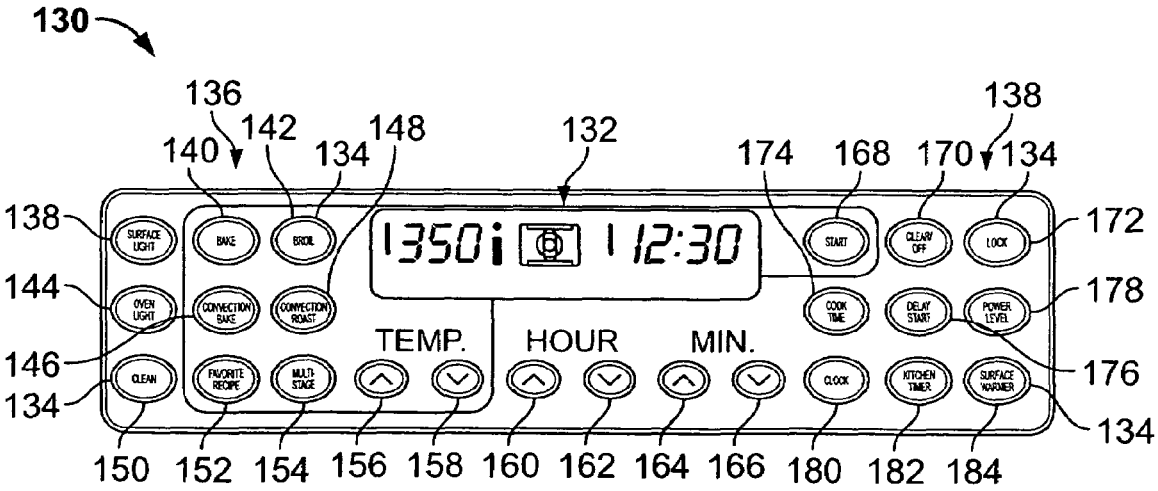
FIG. 3 is a plan view of a control panel interface for the gas range shown in FIGS. 1 and 2.

FIG. 3 illustrates an exemplary input interface panel 130 for range 10 shown in FIGS. 1 and 2. Interface panel 130 includes a display 132 and a plurality of input selectors 134 in the form of touch sensitive buttons or keypads for accessing and/or selecting oven features. In alternative embodiments, other known input selectors are used in lieu of touch sensitive buttons or keypads.

More specifically, input selectors 134 are divided into two groups 136, 138. Group 136 includes a SURFACE LIGHT keypad 138, a BAKE keypad 140, a BROIL keypad 142, an OVEN LIGHT keypad 144, a CONVECTION BAKE keypad 146, a CONVECTION ROAST keypad 148, a CLEAN keypad 150, a FAVORITE RECIPE keypad 152, a MULTI-STAGE keypad 154, a temperature up slew keypad 156 and a temperature down slew keypad 158. Group 138 includes an hour up slew keypad 160 and an hour down slew keypad 162, a minute up slew keypad 164 and a minute down slew keypad 166, a START keypad 168, a CLEAR/OFF keypad 170, a LOCK keypad 172, a COOK TIME keypad 174, a DELAY START keypad 176, a POWER LEVEL keypad 178, a CLOCK keypad 180, a KITCHEN TIMER keypad 182, and a SURFACE WARMER keypad 184.

By manipulating the appropriate input selector 134 in one of the control selector groups 136, 138, the appropriate feature and/or function is activated by an appliance controller (not shown in FIG. 10) and, for most of the features, an icon or indicator is displayed on display 132 to visually indicate selected appliance features and/or operating parameters, such as cooking time, cooking temperature, etc.

Figure 4:
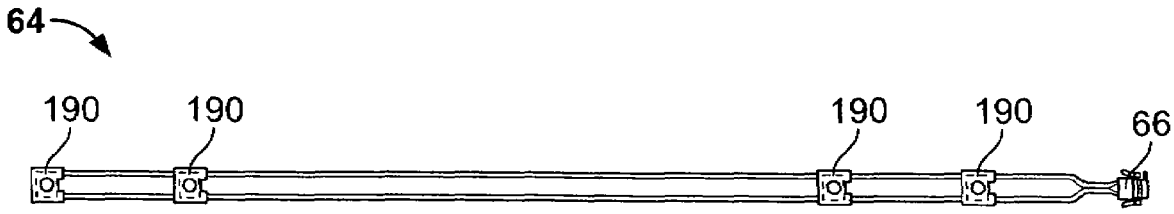
FIG. 4 is schematic view of an exemplary gas supply system for the gas range shown in FIGS. 1 and 2.

FIG. 4 illustrates an exemplary gas supply system for range 10 shown in FIGS. 1 and 2. Gas manifold 64 includes four surface burner element control valves 190 respectively coupled to surface burners 22, 24, 26, and 28 (shown in FIG. 1). Each surface burner element control valve 190 is used to control the gas flow from manifold 64 to the corresponding surface burner 22, 24, 26, 28. Each surface burner element control valve 190 is also coupled to the corresponding control knob 65 (shown in FIG. 2), and can be actuated or de-actuated by manipulating control knob 65.

Lockout valve assembly 66 controls gas flow to gas manifold 64, and is movable between a closed position and an open position, sometimes referred to as a full open position. When lockout valve assembly 66 is in the open position, gas flow is channeled through gas supply line 70 (shown in FIG. 2) to manifold 64 and further to surface burners 22, 24, 26, and 28 when burner valves 190 are actuated. When lockout valve assembly 66 is in the closed position, gas flow is restricted from entering into gas manifold 64 from gas supply line 70, thereby blocking gas flow to surface burners 22, 24, 26, and 28 with burner valves 190 opened. Surface burners 22, 24, 26, and 28 (as well as other heating elements connected to manifold 64) are thereby inoperative and gas flow is avoided. As such, the user is not able to manipulate the control knobs for the gas heating elements.

Figure 5:
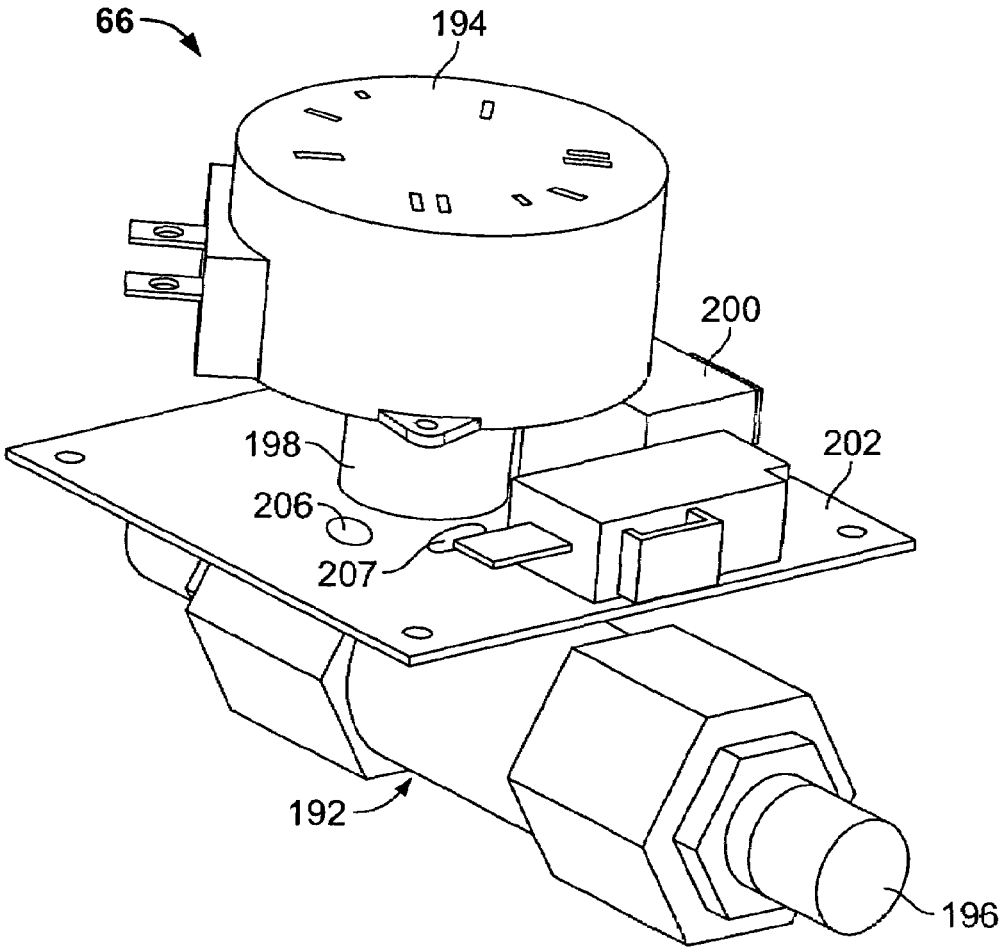
FIG. 5 is a perspective view of an exemplary motorized lockout valve assembly for the gas supply system shown in FIG. 4.
Figure 6:
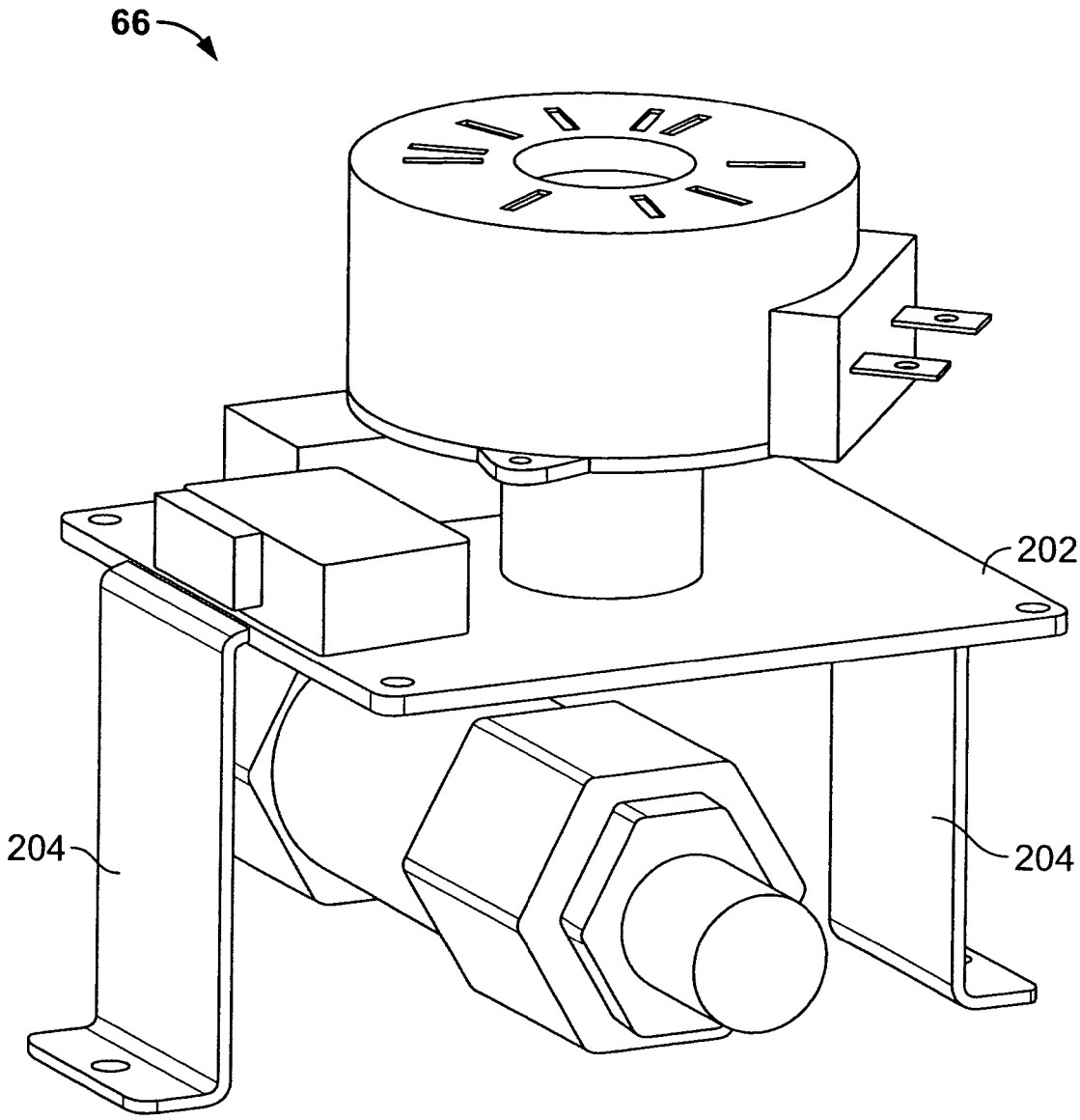
FIG. 6 is a perspective view of an alternative exemplary lockout valve assembly for the gas supply system shown in FIG. 4.

FIG. 5 is a perspective view of an exemplary motorized lockout valve assembly 66 for the gas supply system shown in FIG. 4. FIG. 6 illustrates an alternative embodiment of lockout valve assembly 66. Gas lockout valve assembly 66 includes a lockout valve 192 for connection to a gas line, such as gas line 70 (shown in FIG. 2). Lockout valve assembly 66 also includes an electric motor 194 for actuating lockout valve 192 to open or close a substantially straight fluid path or passage 196 through lockout valve 192 to supply or not supply gas to gas manifold 64 (shown in FIGS. 2 and 4) and therefore to associated gas heating elements.

In one embodiment, lockout valve 192 is a panel mount ball valve including a valve shaft (not shown) rotatably mounted within lockout valve 192, and motor 194 includes an output shaft 198 engaged with a cam 200. Cam 200 is also engaged with the valve shaft, such that motor 194 can rotatably drive the valve shaft to rotate for controlling the gas flow through lockout valve 192. In alternative embodiments, any suitable valve known to those skilled in the art and guided by the teachings herein provided may be employed without departing from the scope of the present invention. In a further embodiment, when being applied with an excessive force, the coupling between cam 200 and output shaft 198 of motor 194 is designed to break before the coupling between cam 200 and the valve shaft breaks. As such, lockout valve 192 is protected from damage in a malfunction situation.

In one embodiment, lockout valve 192, motor 194 and cam 200 are mounted on a mounting bracket 202. As illustrated in FIG. 5, mounting bracket 202 is a metal plate to be directly mounted on a frame or cabinet of an appliance, such as range 10 (shown in FIGS. 1 and 2) by fasteners (not shown). In an alternative embodiment, as illustrated in FIG. 6, mounting bracket 202 further includes at least one support or foot 204 for attachment to an appliance, such as range 10.

In an alternative embodiment, lockout valve assembly 66 is a solenoid type valve instead of the motorized valve. The solenoid type lockout valve assembly 66 includes a solenoid (not shown) drivingly coupled to the valve shaft of lockout valve 192. As such, energizing the solenoid causes lockout valve 192 to open or close passage 196 to supply or not supply gas to gas manifold 64 and therefore to associated surface burner elements 22, 24, 26, 28 (shown in FIGS. 1 and 2). In a further embodiment, the solenoid is a latching type solenoid and keeps opening or closing passage 196 until receiving a changing position signal from the appliance controller (shown in FIG. 10, described in detail hereinafter).

In one embodiment, lockout valve assembly 66 also includes two switches 206, 207 positioned with respect thereto for sensing a position of lockout valve 192. An open position switch 206 and a closed position switch 207 sense whether lockout valve 192 reaches the corresponding open position or closed position, respectively. In one embodiment, switches 206, 207 are used to sense a position of the valve shaft. In another embodiment, switches 206, 207 are used to sense a position of a component which is mechanically coupled with the valve shaft, such as cam 200. As such, switches 206, 207 may indirectly detect a position of the valve shaft based on the position of cam 200. In a further embodiment, switches 206, 207 are used to sense a position of motor 194.

In one embodiment, each switch 206, 207 is a micro-switch including a contact arm (not shown) for detecting the position. The contract arm is displaced when lockout valve 192 moves to the corresponding open position or closed position. In alternative embodiments, any suitable switching mechanism known to those skilled in the art and guided by the teachings herein provided may be employed for sensing the position of lockout valve 192. Further, one or more switches may be employed without departing from the scope of the present invention.

Figure 7:
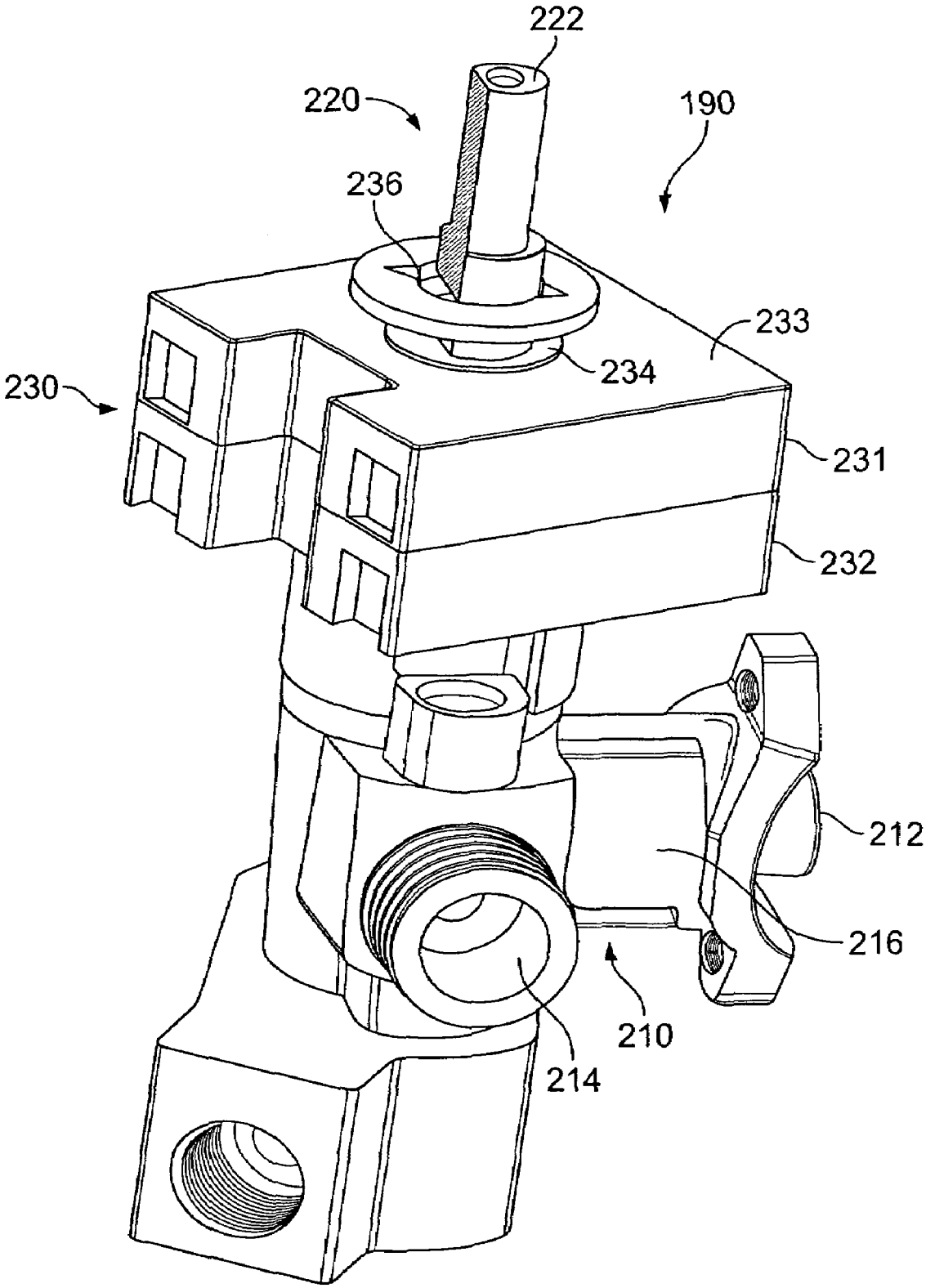
FIG. 7 is a perspective view of an exemplary surface burner element control valve for the gas supply system shown in FIG. 4.

FIG. 7 is a perspective view of exemplary surface burner element control valve 190 for the gas supply system shown in FIG. 4. Burner valve 190 includes a valve body 210 defining a gas inlet 212 and a gas outlet 214 thereon, and a flow path 216 extending between gas inlet 212 and gas outlet 214. Gas inlet 212 is coupled in flow communication with gas manifold 64 (shown in FIGS. 2 and 4), and gas outlet 214 is coupled in flow communication with corresponding surface burner 22, 24, 26, 28 (shown in FIGS. 1 and 2).

Burner valve 190 also includes a control shaft 220 movably received within valve body 210 and controlling the gas flow through flow path 216. Control shaft 220 further includes an upper portion 222 extending upward from valve body 210. Upper portion 222 is coupled to the corresponding burner control knob 65 (shown in FIG. 2) for manipulation. As such, the operator may rotate control knob 65 to move control shaft 220 between an open position and a closed position for controlling gas flow from lockout valve assembly 66 to corresponding surface burner element 22, 24, 26, or 28. In one embodiment, gas is prevented from flowing to corresponding surface burner element 22, 24, 26, 28 when burner valve 190 is in the closed position, and gas is allowed to flow to corresponding surface burner element 22, 24, 26, or 28 when burner valve 190 is in the open position. In a further embodiment, the operator may rotate control shaft 220 to adjust the gas flow rate through the corresponding burner valve 190.

Burner valve 190 also includes a switch assembly 230 positioned thereon for detecting a position of burner valve 190. In one embodiment, switch assembly 230 includes two switches 231, 232 stacked together to form a switch body 233, and a rotator 234 rotatably received within switch body 233. Each switch 231, 232 is used to detect whether control shaft 220 is in the corresponding open position or closed position, respectively. Switch body 233 is mounted onto valve body 210 by screws (not shown), and rotator 234 defines a shaft opening 236 therethrough which is complementary with respect to control shaft 220 in sectional view. Control shaft 220 extends through shaft opening 236, such that rotator 234 moves together with control shaft 220 for sensing the position of control shaft 220. In alternative embodiments, any suitable switching mechanism known to those skilled in the art and guided by the teachings herein provided may be employed for sensing the position of burner valve 190 without departing from the scope of the present invention. Further, one or more switches may be employed for sensing one or more positions of burner valve 190.

Figure 8:
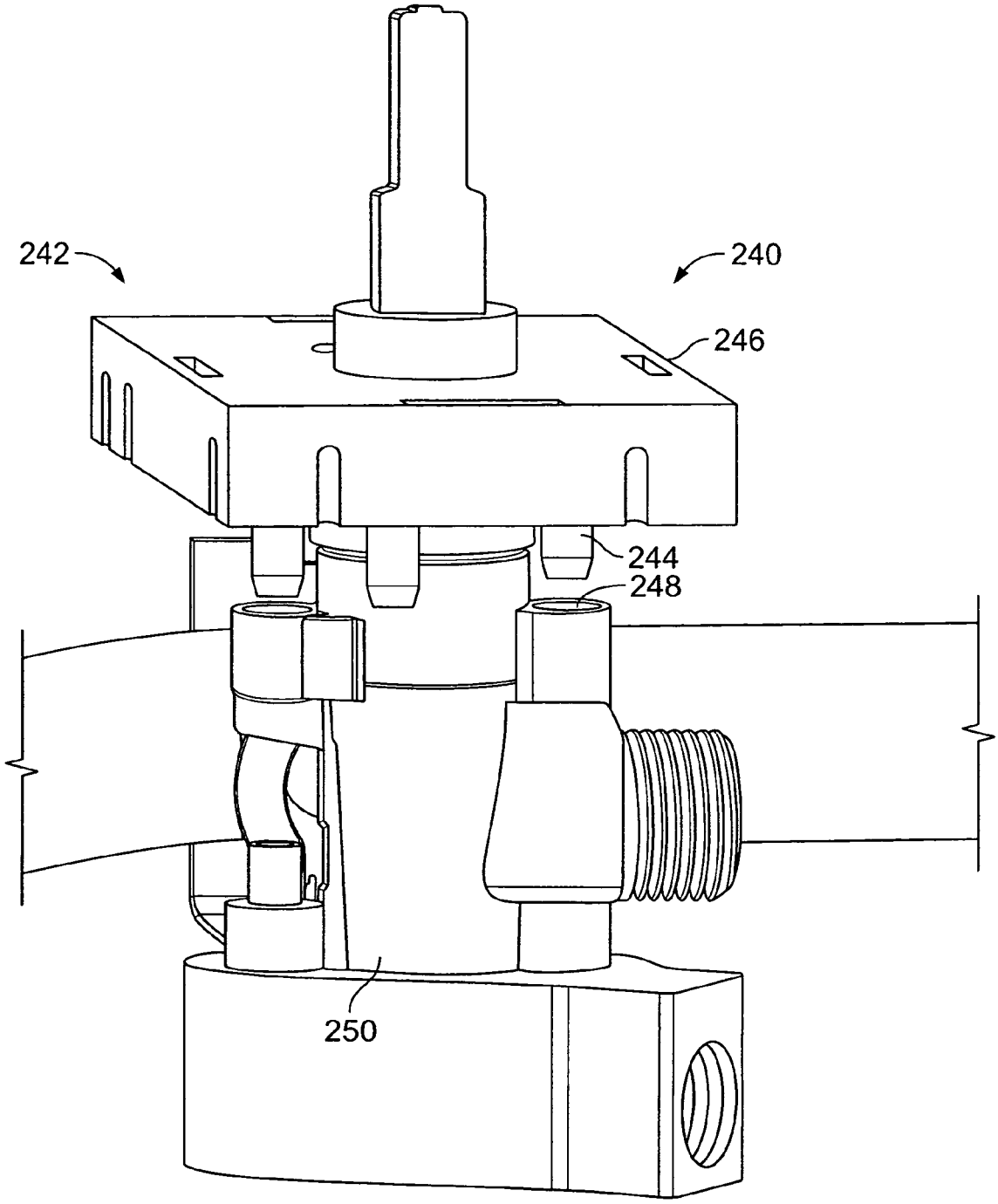
FIG. 8 is a perspective view of an alternative surface burner element control valve for the gas supply system shown in FIG. 4.

FIG. 8 is a perspective view of an alternative surface burner element control valve 240 for the gas supply system shown in FIG. 4. Burner valve 240 is similar to burner valve 190 shown in FIG. 7, except that burner valve 240 includes a single stack type switch 242 for detecting both the open position and the closed position of burner valve 190. Switch 242 further includes a plurality of protrusions 244 extending downward from a switch body 246. Each protrusion 244 is securely received in a corresponding opening 248 defined on a valve body 250 positioned below switch 242. As such, switch 242 is fastened onto valve body 250 to reduce or eliminate vertical and/or radial movement of switch body 246 during the rotation of control shaft 220.

Figure 9:
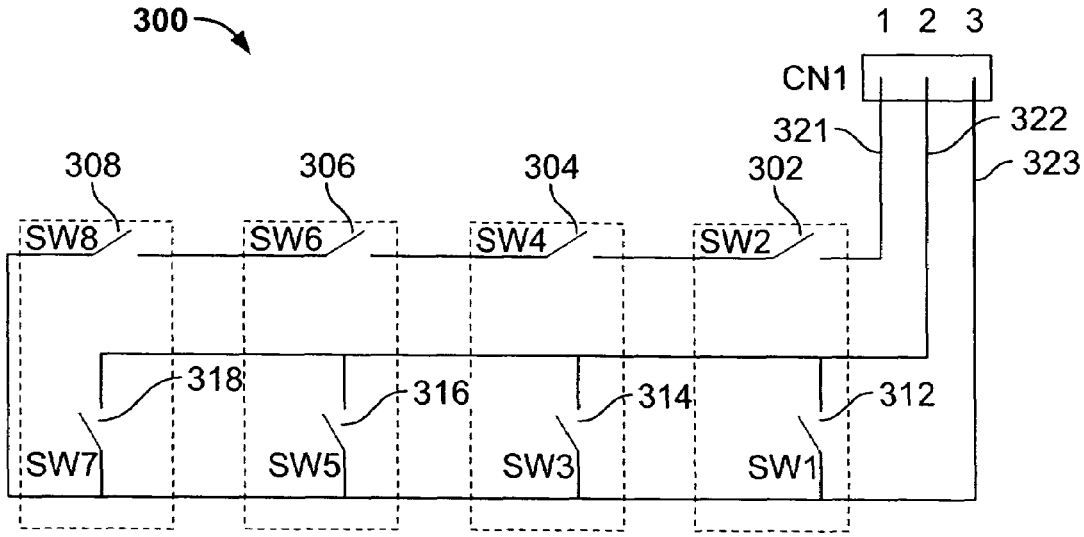
FIG. 9 is a schematic view of an exemplary circuit for the gas range shown in FIGS. 1 and 2.

FIG. 9 is a schematic view of an exemplary circuit 300 for range 10 shown in FIG. 1. Circuit 300 includes a first group of switches 302, 304, 306, and 308 for respectively detecting whether the corresponding burner valve 190 (shown in FIG. 4) is positioned at the closed position, and a second group of switches 312, 314, 316, and 318 for respectively detecting whether the corresponding burner valve 190 is positioned at the open position. In alternative embodiments, switch assembly 230 and/or switch 242 (shown in FIGS. 7 and 8) may be employed in circuit 300.

In one embodiment, control shaft 220 is rotatably positioned within burner valve 190, and each switch 302, 304, 306, 308 is used to detect whether control shaft 220 is positioned within an angle range of about −15 to about +15 degrees with respect to the predetermined closed position. When control shaft 220 is detected positioned within this angle range, the corresponding switch 302, 304, 306, 308 is closed. As such, lines 321 and 323 are connected when all switches 302, 304, 306, 308 are closed, and a signal indicating that all burner valves 190 are in the closed position is sent to the appliance controller (shown in FIG. 10). In alternative embodiments, the angle range may be greater or less than ±15 degrees.

In one embodiment, when control shaft 220 is rotated from the closed position to the open position, gas is supplied to corresponding surface burner 22, 24, 26, 28 if lockout valve assembly 66 (shown in FIG. 2) is in the open position. Each switch 312, 314, 316, 318 is used to detect whether the corresponding control shaft 220 is positioned within an angle range of +15 to +75 degrees with respect to the predetermined closed position. When control shaft 220 is detected positioned within this angle range, the corresponding switch 312, 314, 316, 318 is closed, and lines 322 and 323 are connected for energizing a corresponding spark module (not shown) to ignite the gas supplied to the corresponding surface burner 22, 24, 26, 28. In alternative embodiments, the angle range may be less than +15 degrees or greater than +75 degrees.

Figure 10:
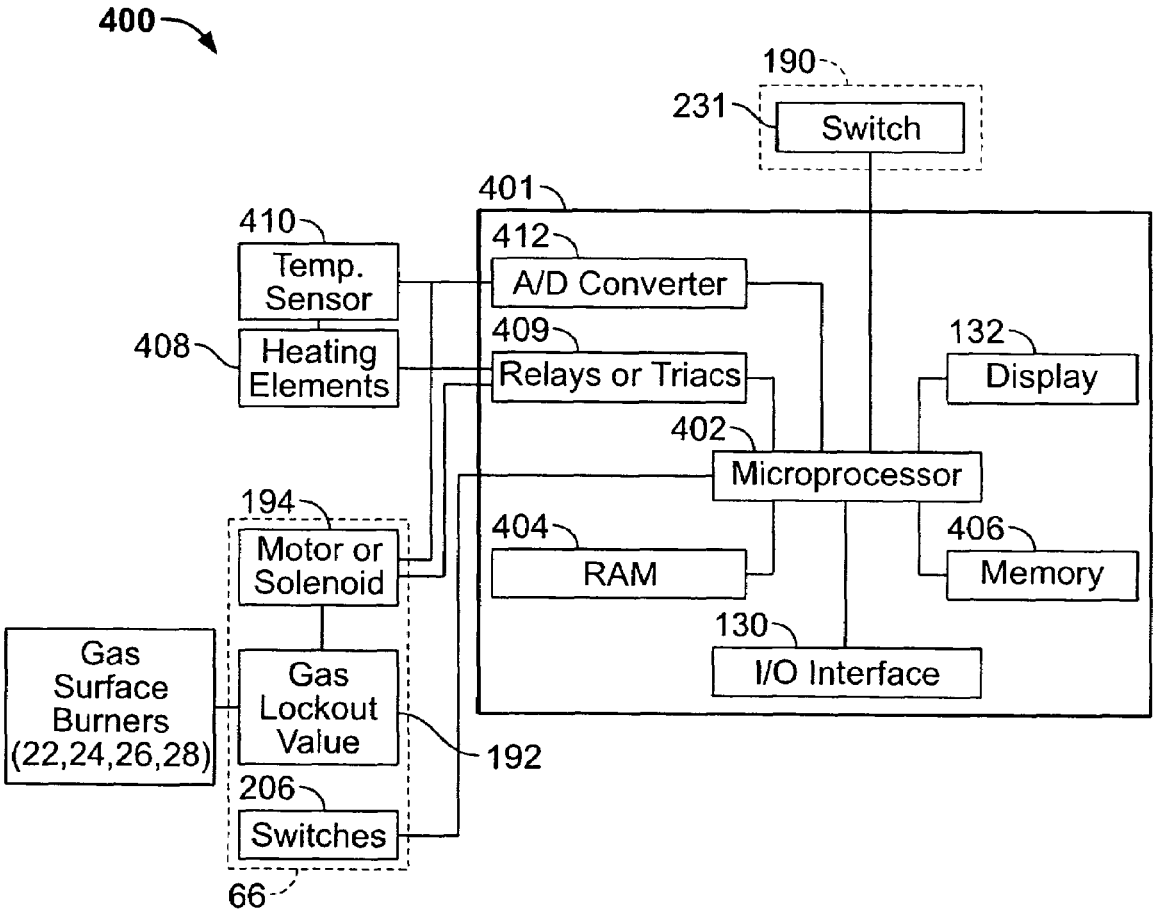
FIG. 10 is a block diagram of an exemplary control system for the gas range shown in FIGS. 1 and 2.

FIG. 10 is a block diagram of a control system 400 for range 10 (shown in FIGS. 1 and 2) including an appliance controller 401 including a microprocessor 402 coupled to input interface 130 and to display 132, and including a RAM memory 404 and a permanent memory 406, such a flash memory (FLASH), programmable read only memory (PROM), or an electronically erasable programmable read only memory (EEPROM) as known in the art. The controller memory is used to store data including, without limitation, calibration constants, oven operating parameters, cooking routine recipe information, required to control heating elements and/or execute user instructions.

Microprocessor 402 is operatively coupled to gas heating elements 408 (i.e., oven bake element, oven broil element, oven convection element, and cooktop surface heating units) for energization thereof through relays, triacs 409, or other known mechanisms (not shown) for cycling electrical power to oven heating elements. One or more temperature sensors 410 sense operating conditions of gas heating elements 408 and are coupled to an analog to digital converter (A/D converter) 412 to provide a feedback control signal to microprocessor 402.

In addition, gas lockout valve assembly 66 is coupled to gas heating elements (such as burners 22, 24, 26, 28 shown in FIG. 1) for regulating a gas supply thereto, as described above. Lockout valve assembly 66 is operatively coupled to microprocessor 402 and is responsive thereto. Burner valve switches 230 are operatively coupled to microprocessor 402, and provide feedback to microprocessor 402 indicative of an open position or closed position for corresponding burner valve 190. As such, microprocessor 402 activates lockout valve assembly 66 to move between the closed position and the open position based on the signal received from switches 230 and the manipulation input from I/O interface 130 (described in detail hereinafter).

Switches 206 (shown in FIG. 4) also provide feedback to microprocessor 402 indicative of an open position or closed position of lockout valve 192, and microprocessor 402 causes appropriate visual indicia via interface 130 and/or audible signals to alert the operator of the gas lockout condition when the gas lockout feature is activated.

In operation, when the gas lockout feature is selected through operator manipulation of I/O interface 130, microprocessor 402 detects the position of all burner valves 190 through the corresponding burner valve switches 230. If all burner valves 190 are detected in the closed position, microprocessor 402 signals lockout valve assembly 66. More specifically, microprocessor 402 energizes motor 194 (shown in FIG. 5) or the solenoid (not shown) to close lockout valve 192 of lockout valve assembly 66. In one embodiment, microprocessor 402 is configured to display "Loc" on display 132 for visually indicating to the operator that lockout valve 192 is moved to the closed position.

When the gas lockout feature is deselected through user manipulation of I/O interface 130, microprocessor 402 also detects the position of all burner valves 190 through burner valve switches 230. If all burner valves 190 are detected in the closed position, microprocessor 402 signals lockout valve assembly 66. More specifically, microprocessor 402 energizes motor 194 or the solenoid to open lockout valve 192. In one embodiment, microprocessor 402 is configured to stop displaying "Loc" on display 132 when lockout valve 192 moves to the open position.

In one embodiment, if at least one burner valve 190 is detected in the open position when the gas lockout feature is selected or deselected, microprocessor 402 prevents lockout valve 192 from moving between the closed position and the open position. When at least one switch 302, 304, 306, 308 (shown in FIG. 9) is open, lines 321 and 323 (shown in FIG. 9) are disconnected such that microprocessor 402 determines at least one burner valve 190 is in the open position. Microprocessor 402 then visually and/or audibly prompts the operator to move surface burner valves 190 to the closed position. Microprocessor 402 may display "turn surface burners off" on display 132, and return to a standby situation without operating lockout valve assembly 66.

In a further embodiment, when the gas lockout feature is selected, microprocessor 402 also detects the operation status of the oven (not shown). If all burner valves 190 are detected in the closed position and the oven is in an off state, microprocessor 402 drives lockout valve 192 to move. If the oven is performing some predetermined functions, such as for example, baking, broiling, or a timing function, microprocessor 402 visually and/or audibly prompts the operator of an error. Microprocessor 402 then returns to the previous operation without operating lockout valve assembly 66.

In one embodiment, when the lockout feature is activated, any manipulation input other than deselecting the gas lockout feature is ignored. In another embodiment, if burner valve 190 is turned on when the lockout feature is activated, microprocessor 402 visually and/or audibly prompts the operator to turn off burner valves 190.

When a self clean mode is selected for the oven, microprocessor 402 automatically locks door 16 (shown in FIG. 1) and moves lockout valve 192 to the closed position if all burner valves 190 are in the closed position. Microprocessor 402 then performs a self clean process in the oven for a predetermined time period. After the self clean process, microprocessor 402 waits until the temperature within the oven is below a predetermined safe door unlock temperature. Microprocessor 402 then opens lockout valve 192 and unlocks door 16 if all burner valves 190 are in the closed position.

In one embodiment, if burner valve 190 is turned on during the self clean mode, microprocessor 402 continues the self clean process and visually and/or audibly prompts the operator of an error. In a further embodiment, microprocessor 402 displays "turn surface burners off" on display 132, and continues producing audible signals until all burner valves 190 are turned off. If burner valve 190 is still on after the self clean process, microprocessor 402 maintains door 16 locked and lockout valve assembly 66 is closed until all burner valves 190 are turned off.

In one embodiment, microprocessor 402 monitors the movement of lockout valve assembly 66 and fault conditions, such as motor failure, switch failure, and/or miswiring, based on the signal received from switches 206. As described above, open/closed position switch 206 is respectively configured to close to connect an OPEN/CLOSED circuit when lockout valve 192 reaches the corresponding full open or closed position, and configured to open to disconnect the OPEN/CLOSED circuit when lockout valve 192 leaves the corresponding full open position or closed position.

When only one of the OPEN and the CLOSED circuits is closed and the other one is open, microprocessor 402 determines that lockout valve 192 reaches the corresponding full open or closed position. When both of the OPEN and CLOSED circuits are open, microprocessor 402 indicates lockout valve 192 is positioned between the full open position and the closed position. As such, microprocessor 402 determines that lockout valve 192 is moving between the full open position and the closed position. When the OPEN circuit and the CLOSED circuit are closed, microprocessor 402 determines that the fault conditions occur.

In one embodiment, a data indicative of the state of lockout valve assembly 66 is stored in permanent memory 406. In a further embodiment, "1" is defined as the closed state of lockout valve assembly 66, and "0" is defined as the open state of lockout valve assembly 66. Microprocessor 402 is configured to change the lockout valve data to "1" upon deciding to activate lockout valve assembly 66 to the closed position. In a further embodiment, microprocessor 402 changes the lockout valve data to "1" before initiating driving lockout valve assembly 66 to the closed position. In an alternative embodiment, microprocessor 402 changes the lockout valve data to "1" upon determining to activate the self clean mode. Microprocessor 402 changes the lockout valve data to "0" only when lockout valve 192 moves to the open position.

In a further embodiment, microprocessor 402 compares the lockout valve data stored in permanent memory 406 with the signal received from lockout valve switches 206 when range 10 is powered up. When the lockout valve data is "1", microprocessor 402 drives lockout valve 192 to the closed position if lockout valve 192 is detected in the full open position or between the closed position and the full open position. When the lockout valve data is "0", microprocessor 402 determines the fault conditions occur if lockout valve assembly 66 is detected in the closed position or between the closed position and the full open position.

In one embodiment, when activating lockout valve 192 to move from the full open position to the closed position, microprocessor 402 uses a time counter (not shown) to monitor the movement. When open position switch 206 is open, which indicates lockout valve 192 leaves the full open position, microprocessor 402 detects whether lockout valve 192 reaches the closed position within a predetermined time period, such as for example 30 seconds. If closed position switch 206 is not closed within the predetermined time period, microprocessor 402 determines the fault conditions occur. In another embodiment, if open position switch 206 is not open and close position switch 206 is not closed within the predetermined time period, microprocessor 402 also determines the fault conditions. In one embodiment, microprocessor 402 monitors the movement of lockout valve 192 from the closed position to the full open position in a similar method.

Upon determining the fault condition, microprocessor 402 cancels all functions including driving lockout valve 192 to move, and visually and/or audibly prompts the operator of error. If burner valve 190 is turned on in the fault condition, microprocessor 402 further continues visually and/or audibly prompting the operator to turn off all burner valves 190 until the operator follows the prompt. The fault conditions may be reset when the main power of range 10 is turned off and turned on again.

In one embodiment, the microprocessor opens the lockout valve when all surface burner element control valves are closed. As such, gas is not unintentionally introduced into the kitchen room when the lockout valve is de-actuated, even when at least one of the burner control knobs is already unknowingly actuated. In a further embodiment, the microprocessor visually and/or audibly prompts the operator of such situation, which effectively prompts the operator of such error.

While the invention has been described in terms of various specific embodiments, those skilled in the art will recognize that the invention can be practiced with modification within the spirit and scope of the claims.

What is claimed is:

1. A gas supply system for a cooking appliance including at least one gas surface burner element in selective flow communication with a manifold, the manifold in flow communication with a gas supply line, said gas supply system comprising:

a surface burner element control valve operatively coupled to each surface burner element, said surface burner element control valve movable between an open position and a closed position to control gas flow from the manifold to the surface burner element;

a lockout valve operatively coupled to the manifold along the gas supply line and configured to control gas flow to the manifold, said lockout valve movable between a closed position restricting gas flow to the manifold and an open position allowing gas flow to the manifold;

a switch assembly comprising a first switch positioned with respect to said surface burner element control valve, a position of said surface burner element control valve detectable by said first switch; and a controller operatively coupled to said lockout valve and in signal communication with said switch assembly, said controller configured to activate said lockout valve to move from the closed position to the open position based on a signal received from said first switch indicating that said surface burner element control valve is in the closed position.

2. A system in accordance with claim 1 wherein said controller is configured to prevent said lockout valve from moving between the closed position and the open position when said surface burner element control valve is in the open position.

3. A system in accordance with claim 2 wherein said gas supply system comprises a plurality of gas surface burner elements coupled to the manifold and a plurality of surface burner element control valves, each surface burner element control valve operatively coupled to a corresponding surface burner element and configured to control gas flow from the manifold to the surface burner element, and said controller is configured to prevent said lockout valve from moving when at least one surface burner element control valve is in the open position.

4. A system in accordance with claim 1 wherein said controller is configured to prompt an operator to move said surface burner element control valve to the closed position when said controller receives an operation input signal to change a lockout valve position and said surface burner element control valve is in the open position.

5. A system in accordance with claim 1 further comprising a memory configured to store a position of said lockout valve.

6. A system in accordance with claim 1 further comprising-at least one second switch configured to detect a position of said lockout valve.

7. A system in accordance with claim 1 further comprising a motor operatively coupled to said controller, said motor configured to drivingly move said lockout valve between the closed position and the open position.

8. A cooking appliance comprising:

a manifold in flow communication with a gas supply line;

at least one gas surface burner element in selective flow communication with said manifold;

a surface burner element control valve coupled to a corresponding said surface burner element, said surface burner element control valve configured to control gas flow from said manifold to said corresponding surface burner element;

a lockout valve coupled in flow communication with said manifold, said lockout valve movable between a closed position restricting gas flow to said manifold, and an open position allowing gas flow to said manifold; and a controller operatively coupled to said lockout valve, said controller configured to activate said lockout valve to move from the open position to the closed position based on an operational status of each said surface burner element control valve.

9. A cooking appliance in accordance with claim 8 further comprising a switch assembly comprising a first switch positioned with respect to said surface burner element control valve, a position of said surface burner element control valve detectable by said first switch.

10. A cooking appliance in accordance with claim 9 wherein said controller is configured to prevent said lockout valve from moving between the closed position and the open position based on a signal received from said at least one switch.

11. A cooking appliance in accordance with claim 8 wherein said surface burner element control valve is movable between an open position and a closed position to control gas flow from said manifold to said surface burner element, said controller configured to prevent said lockout valve from moving between the closed position and the open position when said surface burner element control valve is in the open position.

12. A cooking appliance in accordance with claim 11 further comprising a plurality of gas surface burner elements coupled to said manifold and a plurality of surface burner element control valves, each said surface burner element control valve operatively coupled to a corresponding said surface burner element and configured to control gas flow from said manifold to said surface burner element, said controller configured to prevent said lockout valve from moving when at least one of said plurality of surface burner element control valves is in the open position.

13. A cooking appliance in accordance with claim 8 wherein said controller is configured to prompt an operator to move said surface burner element control valve to the closed position when said controller receives an operation input signal to change a lockout valve position and said surface burner element control valve is in the open position.

14. A cooking appliance in accordance with claim 8 further comprising a permanent memory configured to store a date representative of a status of said lockout valve.

15. A cooking appliance in accordance with claim 8 wherein said lockout valve comprises one of a motorized valve and a solenoid valve operatively coupled to said controller, said one of said motorized valve and said solenoid valve configured to move between the closed position and the open position.

16. A method for controlling a gas supply for a cooking appliance, the method comprising:

providing a manifold in flow communication with a gas supply line;

coupling at least one gas surface burner element in selective flow communication with the manifold;

coupling a surface burner element control valve to the corresponding surface burner element, the surface burner element control valve configured to control gas flow from the manifold to the surface burner element;

coupling a lockout valve in flow communication with the manifold, the lockout valve movable between a closed position restricting gas flow to the manifold, and an open position allowing gas flow to the manifold; and operatively coupling a controller to the lockout valve, the controller configured to activate the lockout valve to move from the open position to the closed position based on an operational status of each surface burner element control valve.

17. A method in accordance with claim 16 further comprising positioning a switch assembly comprising a first switch with respect to the surface burner element control valve, the first switch configured to detect a position of the surface burner element control valve.

18. A method in accordance with claim 17 further comprising preventing the lockout valve from moving between the closed position and the open position based on a signal received from the switch.

19. A method in accordance with claim 16 further comprising coupling the surface burner element control valve such that the surface burner element control valve is movable between an open position and a closed position to control gas flow from the manifold to the surface burner element, and preventing the lockout valve from moving between the closed position and the open position when the surface burner element control valve is open.

20. A cooking appliance in accordance with claim 19 further comprising coupling a plurality of gas surface burner elements to the manifold, operatively coupling each of a plurality of surface burner element control valves to a corresponding surface burner element, each surface burner element control valve configured to control gas flow from the manifold to the surface burner element, and preventing the lockout valve from moving when at least one of the plurality of surface burner element control valves is open.

* * * * *